US010934802B2

(12) United States Patent
Brandsdal

(10) Patent No.: US 10,934,802 B2
(45) Date of Patent: Mar. 2, 2021

(54) PLUG ARRANGEMENT COMPRISING A DISINTEGRATABLE PLUG ELEMENT

(71) Applicant: Frac Technology AS, Ytre Arna (NO)

(72) Inventor: Viggo Brandsdal, Ytre Arna (NO)

(73) Assignee: FRAC Technology AS

( * ) Notice: Subject to any disclaimer, the term of this patent is extended or adjusted under 35 U.S.C. 154(b) by 159 days.

(21) Appl. No.: 16/035,228

(22) Filed: Jul. 13, 2018

(65) Prior Publication Data

US 2019/0017345 A1 Jan. 17, 2019

(30) Foreign Application Priority Data

Jul. 14, 2017 (NO) ..... 20171183

(51) Int. Cl.
*E21B 33/12* (2006.01)
*E21B 34/06* (2006.01)

(52) U.S. Cl.
CPC ..... *E21B 33/1208* (2013.01); *E21B 34/063* (2013.01)

(58) Field of Classification Search
CPC ..... E21B 33/12; E21B 33/1208; E21B 34/063
See application file for complete search history.

(56) References Cited

U.S. PATENT DOCUMENTS

| | | | |
|---|---|---|---|
| 5,181,571 | A | 1/1993 | Mueller et al. |
| 9,593,542 | B2 | 3/2017 | Getzlaf et al. |
| 2008/0223572 | A1 | 9/2008 | Vert et al. |
| 2011/0277988 | A1 | 11/2011 | Wee |
| 2016/0060998 | A1* | 3/2016 | Hiorth ..... E21B 33/1208 166/192 |
| 2017/0096875 | A1 | 4/2017 | Ravensbergen et al. |

FOREIGN PATENT DOCUMENTS

| | | | |
|---|---|---|---|
| NO | 340634 | B1 | 5/2017 |
| NO | 340829 | B1 | 6/2017 |
| WO | WO 2005/049961 | A1 | 6/2005 |
| WO | WO 2007/108701 | A1 | 9/2007 |
| WO | WO 2009/110805 | A1 | 9/2009 |
| WO | WO 2009/116871 | A1 | 9/2009 |
| WO | WO 2009/126049 | A1 | 10/2009 |
| WO | WO 2014/154464 | A2 | 10/2014 |

* cited by examiner

*Primary Examiner* — Catherine Loikith
(74) *Attorney, Agent, or Firm* — Vinson & Elkins L.L.P.

(57) ABSTRACT

A completion pipe comprising a plug arrangement and a method for arranging a completion pipe in a well. The arrangement includes a disintegratable plug element arranged in a plug housing in a pipe string, a seal element arranged to seal between the plug element and the pipe string. The plug element is movable in the axial direction of the pipe string between a first position and a second position.

17 Claims, 13 Drawing Sheets

PLUG ARRANGEMENT COMPRISING A DISINTEGRATABLE PLUG ELEMENT

CLAIM OF PRIORITY

This application claims priority to Norwegian Patent Application No. 20171183 filed Jul. 14, 2017. The disclosure of this prior application is hereby incorporated by reference in its entirety.

The present invention relates to a plug arrangement for use in boreholes, for example, petroleum well boreholes.

BACKGROUND

Today, many wells for oil and gas production are drilled with long horizontal sections. The drilling of a well for hydrocarbon production is typically started by drilling vertically downwards, and then making a turn when nearing a hydrocarbon-bearing layer in the formation. The hydrocarbon-bearing layers typically lie horizontally and it is often desirable that the horizontal part of the well should follow this layer as far as possible. This applies in particular to onshore wells that are drilled in dense shale formation, as the shale may have poor permeability and often must be fractured using hydraulic pressure to be able to be produced in an economically efficient manner. It is a challenge today to complete long horizontal wells using conventional onshore rigs; this is due in part to friction in the hole when the completion pipe is to be run into place in the well.

To remedy this problem an air chamber can be formed in the pipe by having a mechanical valve in the bottom of the pipe whilst a plug is installed further up in the pipe. This produces an air chamber between the two, wherein the air-filled chamber has the effect of enabling the pipe to "float" more easily and helps to reduce the friction between the hole in the rock formation and the completion pipe. It is thus possible to complete longer horizontal sections also, for example, in onshore wells where there is less force to press the completion pipe into the well.

When the completion pipe is in place, the plug must be retrieved or removed from the pipe and the mechanical valve opened to make the well ready for subsequent operations such as cementing, pressure testing and production. Today there are many mechanical plugs that can be set and pulled using, for example, coiled tubing or wireline. These can, however, be impractical as pulling can lead to problems, and in any case such intervention operations take up valuable rig time.

Other scenarios also exist where there is a need to install a removable plug in a pipeline. The present invention also relates to such plugs.

Various plug arrangements used for testing production wells or temporarily blocking pipelines are known. It has been most common to use metal plugs. The disadvantage of plugs of this type is that they are (more) difficult to remove and often result in the presence of parts or pieces of debris in the well, which can in turn cause other problems at a later stage. Plugs of other materials, such as rubber etc., are also available, but these too have drawbacks.

A glass plug can be made of a single glass layer or may comprise several layers of glass, optionally with other materials between the layers. Such materials may be solid substances, such as ceramic substances, plastic, felt or even cardboard, but they may also comprise fluids in liquid or gas form. Areas of vacuum can also be incorporated in the plug. In this document "glass" is to be understood as either one single layer of glass or multiple layers. It should also be understood that the reference to "glass" could comprise other similar materials, such as ceramic materials, i.e., materials that have properties which in this connection are similar to those of glass, in addition to other properties that are also desirable. A glass layer may also be referred to as a glass plate or glass disc. The glass plug is usually arranged in a housing, and in addition there will be a need for a device capable of removing the plug. The housing can comprise a separate part or be incorporated in a pipe section. Usually glass which has undergone some form of treatment will be used, preferably to make it stronger/tougher in the sealing phase, whilst being (more) easily crushed in the crushing phase. A treatment of this kind could, e.g. comprise processing of the glass structure itself and/or the glass surface.

Devices for removing the plug are usually incorporated into or placed on or by the plug, that is to say that they are installed together with or at the same time as the plug, either in the plug itself or in the housing or in connection with a pipe section. When the plug is to be removed it is well known to use explosive charges to crush or shatter the plug, normally by placing the explosive inside the plug, or on the surface thereof. This is known from WO 2005/049961 A1. There are a number of disadvantages associated with the installation and use of explosive charges in production wells. There is, for example, always a certain risk of explosives or parts thereof remaining undetonated in the well, which is not considered acceptable by the operator. The handling of plugs fitted with explosives, both during transport (especially international) and the actual installation is also much more complicated as many safety-related conditions must be taken into consideration, since the explosives pose a potential risk to users during the handling of the plug.

There are also crushing mechanisms based on mechanical solutions, e.g., spikes, pressure, hydraulic systems etc. A solution that does not use explosives and is integrated in the plug structure is to subject the plug to large point pressure load. This is taught in WO 2009/116871 A1, where the device for destroying the plug comprises a means designed to move radially when a trigger element is moved in an axial direction, and in WO 2009/110805 A1, where areas subjected to such large pressure load are weakened during the construction of the plug so that it is crushed more easily.

Another solution is to provide an incompressible or barely compressible fluid between a plurality of glass plates, which on a signal for opening is drained out into a separate atmospheric chamber. The plug elements will then collapse through the action of hydrostatic pressure. However, if there is a leak in the atmospheric chamber, this will not work, since the fluid cannot be drained. Another disadvantage of this solution is that the structure of the plug must be weaker than desirable, since the various plug components are required to be sufficiently thin to rupture through the action of well pressure only.

Similar solutions are also known from WO 2009/126049 A1, WO 2007/108701 A1, WO 2014/154464 A2 and U.S. Pat. No. 9,593,542.

As the industry moves towards extraction of more unconventional resources and more challenging reservoirs, and the requirements as regards operating safety and uptime increase even for conventional wells, there is a continuing need for improved technology in the field of plug arrangements for use in boreholes. It is an aim of the present invention to provide plugs, plug arrangements and associated methods which have such advantages and/or is not burdened with one or more disadvantages of the prior art.

SUMMARY

In an embodiment, a plug arrangement is provided comprising a disintegratable plug element arranged in a plug housing in a pipe string, the pipe string having a pressure-resistant wall that delimits an inner passage in the pipe string from an outside of the pipe string, where the plug element is arranged against the pressure-resistant wall and a seal element is arranged to seal between the plug element and the pressure-resistant wall, where the plug element is movable in the axial direction of the pipe string between a first position in which the plug element is spaced from a loading device that is fixed in the plug housing and a second position in which the plug element is in contact with the loading device, and the seal element is arranged to seal between the plug element and the pressure-resistant wall in both the first and the second position.

In an embodiment, a plug arrangement is provided comprising a disintegratable plug element arranged in a plug housing in a pipe string, a seal element is provided to seal between the plug element and the pipe string, where the plug element is movable in the axial direction of the pipe string between a first position in which the plug element is spaced from a first ring-shaped seat in the plug housing and a second position in which the plug element is in contact with the first ring-shaped seat in the plug housing, wherein the plug arrangement further comprises an axially movable seat element with a second ring-shaped seat arranged to support the plug element in the first position, the seat element having a shear element arranged against the plug housing to prevent axial movement of the seat element until the shear element has applied thereto a force higher than a predetermined force.

In an embodiment, a completion pipe is provided comprising a plug arrangement, where the pipe string constitutes parts or the whole of the completion pipe.

In an embodiment, a method is provided for arranging a completion pipe in a well, the completion pipe comprising a first and a second plug arrangement each of which has a disintegratable plug element and an activation mechanism to cause disintegration of the plug element, and where the first and the second plug arrangement define between them an inner volume in the completion pipe, the method comprising: running the completion pipe into the well, causing disintegration of the plug element in the second plug arrangement by activating the activation mechanism from a surface, causing disintegration of the plug element in the first plug arrangement by activating the activation mechanism from a surface and pumping a cement down through the completion pipe and out of an end opening of the completion pipe.

The detailed description below and the appended dependent claims describe further embodiments.

BRIEF DESCRIPTION OF THE DRAWINGS

A detailed, but non-limiting, description of embodiments is given below with reference to the attached drawings, wherein.

DETAILED DESCRIPTION

Various illustrative embodiments will now be described in greater detail. As will be understood, the figures illustrate these embodiments and aspects thereof in a simplified and schematic manner in order for the presentation to be clear. Relative sizes, thicknesses etc. between elements may therefore not necessarily represent their actual values in a practical implementation.

In an embodiment, a plug arrangement is provided which can be used as a flotation plug for use in hydrocarbon wells, the plug comprising a crushable glass material or other frangible material such as ceramics or the like.

Figure 1:
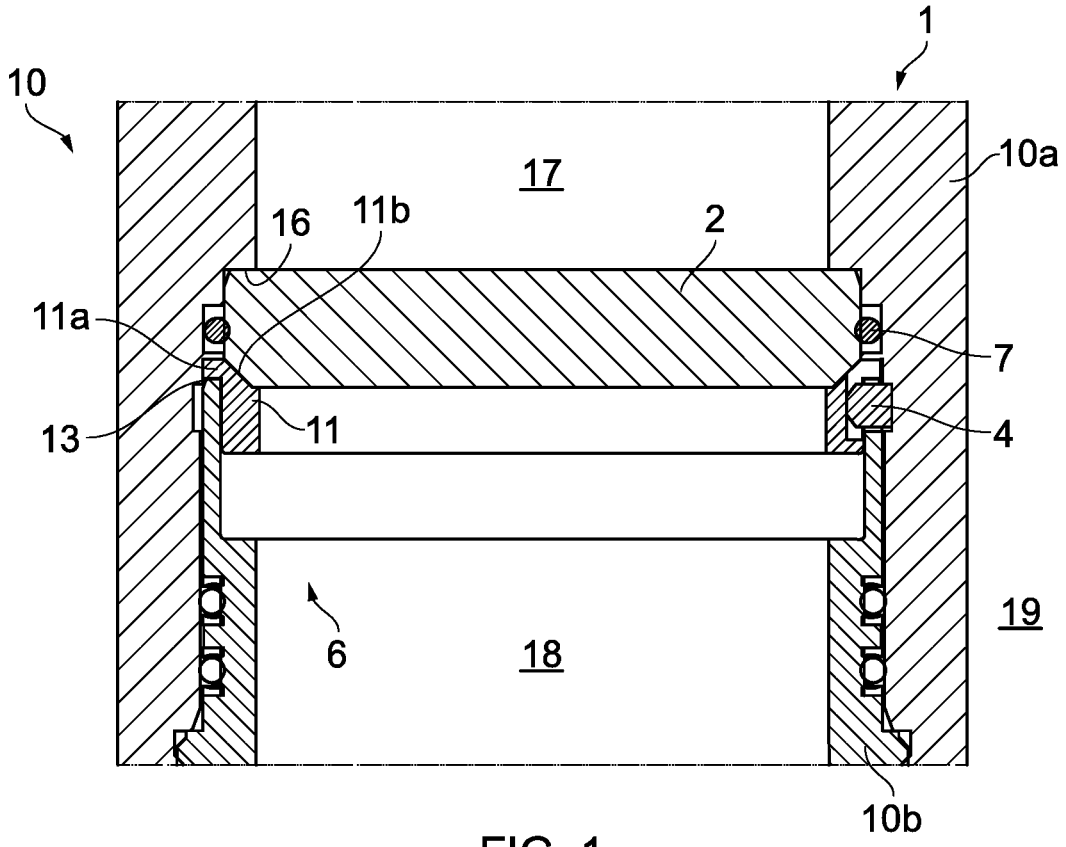
FIG. 1 shows a plug arrangement comprising a disintegratable plug element.

FIG. 1 shows the plug arrangement 1 comprising a disintegratable plug element 2 arranged in a plug housing 6 in a pipe string 10. The pipe string 10 and the plug housing 6 comprise pressure-resistant walls 10*a*,10*b* arranged as a pressure-tight barrier between an interior 17,18 and an exterior 19 of the pipe string 10. The pipe string 10 may be part of a casing or a completion pipe for use in a petroleum well. The plug element 2 may be a glass plug, or a plug that is wholly or partly made of glass, a ceramic material, or a vitrified material. Materials described in the aforementioned patent documents may, for example, also be suitable for use in this embodiment.

Figure 2:
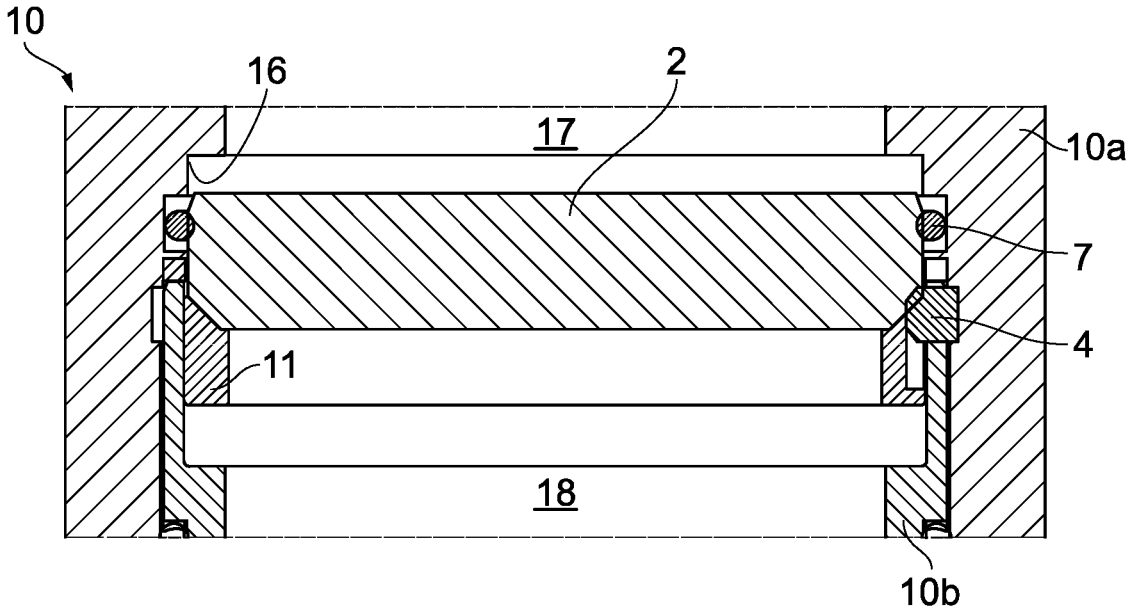
FIG. 2 shows the plug of FIG. 1 in a second operational position.

The plug element 2 is movable in the axial direction of the pipe string 10 between a first position in which the plug element 2 is spaced from a loading device 4 that is fixed in the plug housing 6 and a second position in which the plug element 2 is in contact with the loading device 4. In FIG. 1, the plug element 2 is in the first position. FIG. 2 shows the plug element 2 in the second position. The loading device 4 can, for example, be a pin, spike, blade or similar element.

The plug element 2 is arranged directly against at least one of the pressure-resistant walls 10*a*,10*b* and a seal element 7 is arranged to seal between the plug element 2 and the wall 10*a*,10*b* in the plug housing 6 in both the first and the second position, as well as continuously throughout the movement of the plug element 2 from the first to the second position. The seal element 7 can, for example, be one or more sealing ring(s) arranged around the plug element 2, for example, in a recess or otherwise provided space in the wall 10*a*. Alternatively the seal element 7 can be arranged in a recess in the outer side wall of the plug element 2.

A seat element 11 with a seat 11*b* is provided to support the plug element 2 and prevent axial movement of the plug element 2 in the first position. The seat element 11 is also shown in greater detail in FIG. 6B. The seat element 11 is axially movable in the plug housing 6 and has a first part 11*a* that is arranged to rest against a support surface 13 in the plug housing 6 in order to prevent axial movement of the seat element 11, whilst the seat 11*b* is arranged on a second part 11*d* (see FIG. 6*b*) of the seat element 11. At its upper part, the plug element 2 is supported by a support surface 16 in the plug housing 6. The plug element 2 thus rests in the seat 11*b* in the first position, and cannot move axially in the plug housing 6.

The first part 11*a* is in this embodiment configured as a protrusion around at least a part of a circumference of the seat element 11, and is connected to the second part 11*d* by a connecting part 11*c*. (See FIG. 6B.) The connecting part 11*c* is provided as a shear element, i.e., arranged to break when subjected to a force higher than a predetermined breaking force, for example, in that the connecting part 11*c* is stretched, worn off, torn off or breaks under such load. Alternatively, the support surface 13 can be arranged to give way when subjected to a force higher than a predetermined supporting force, or another type of shear element, such as shear pins or shear discs can be used.

When the plug arrangement 1 is to be removed to open the inner passage of the pipe string 10 for fluid flow, a pressure may be applied across the plug element 2. The volume 17 in the inner passage of the pipe string 10 that is above the plug element 2 is accessible from the surface through the pipe string 10. A high fluid pressure can thus be applied. A downward directed force will then act on the plug element 2. If the seat element 11 is used, the connecting part 11*c* will be torn off, and the seat element 11 will be able to move axially in the plug housing 6. If a seat element 11 is not used, the pressure in the volume 17 must only overcome the friction resistance in order to move the plug element 2.

FIG. 2 shows the situation where the plug element 2 has been moved into the second position, and has come into engagement with the loading device 4. In this embodiment the loading device 4 is a knife blade. By applying a pressure on the plug element 2 from above (i.e., from the volume 17), the plug element 2 will be pressed against the blade 4 and crushed. The plug element 2 is advantageously made of such a material and/or pre-treated (for example, by temperature treatment) such that it is crushed into relatively small bits.

Figure 3:
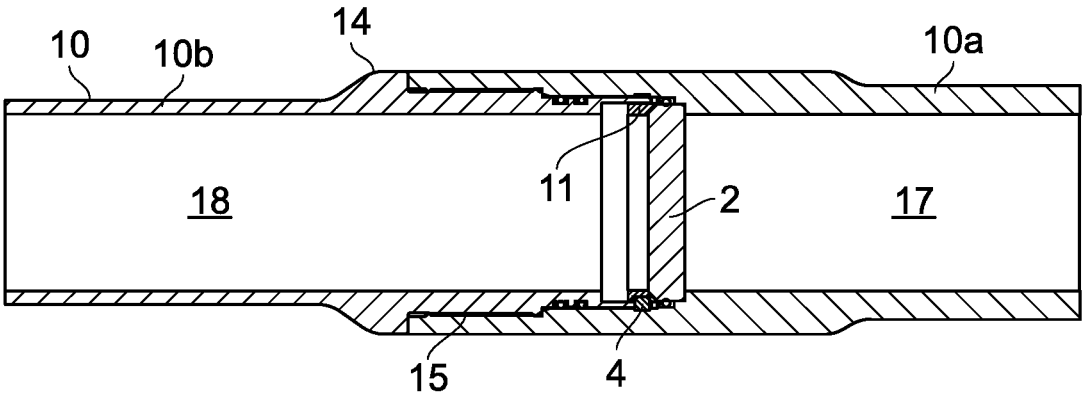
FIGS. 3-5 show a sequence of activation of a plug arrangement.
Figure 4:
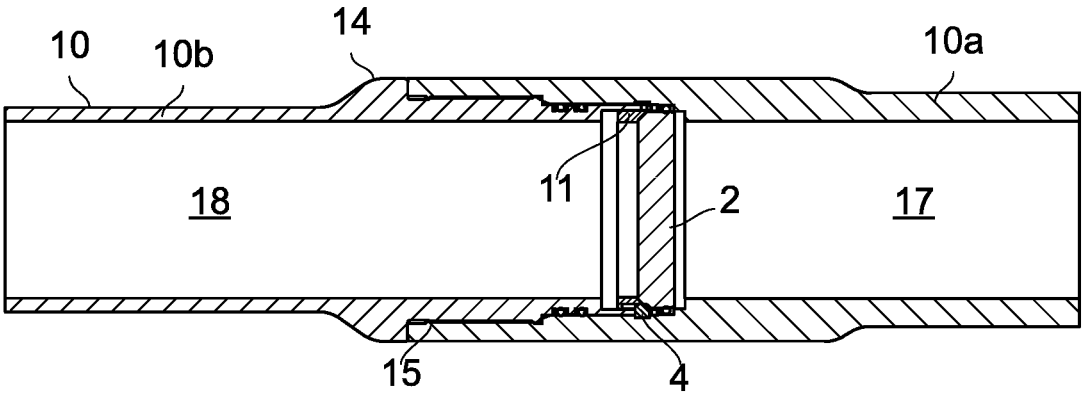
Figure 5:
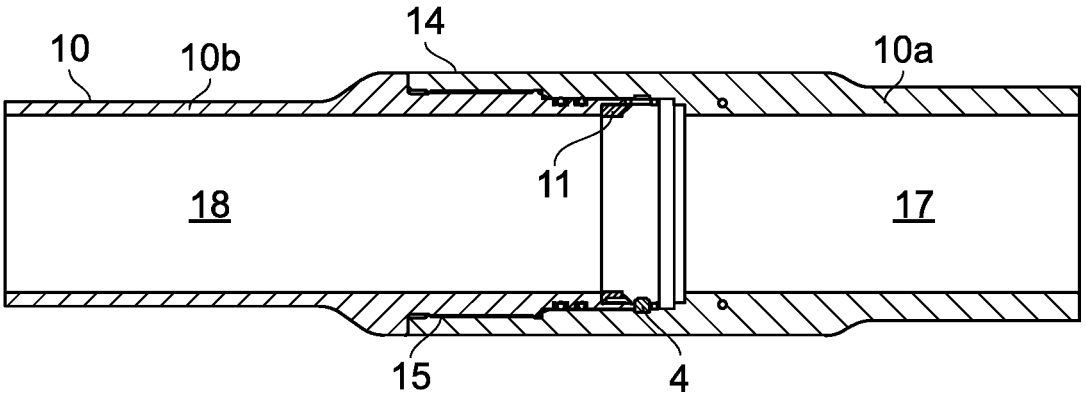

FIGS. 3-5 show a sequence of activation of the plug arrangement 1, where FIG. 3 shows the plug element 2 in its first position, FIG. 4 shows the plug element 2 in its second position, whilst FIG. 5 shows the pipe string 10 after the plug element 2 has been crushed and where the inner passage of the pipe string 10 is thus open.

As shown in FIGS. 1-5, the plug housing 6 can be arranged in a recess in the pressure-resistant wall 10*a*,10*b*, and/or the pipe string 10 can comprise a protrusion 14 radially arranged around the plug housing 6. By arranging the plug housing 6 in a recess and/or providing a protrusion 14 as a part of the pressure-resistant wall 10*a*,10*b*, the structural integrity of the pipe string is maintained, for example in that the wall thickness is sufficient to maintain a required pressure rating for the pipe string 10. In an embodiment, the pressure-resistant wall is provided with a first section 10*a* arranged on a first pipe section and a second section 10*b* arranged on a second pipe section, the first and the second pipe section being connected by a releasable coupling (see FIGS. 3-5). In this embodiment the releasable coupling 15 is a threaded connection.

Figure 6A:
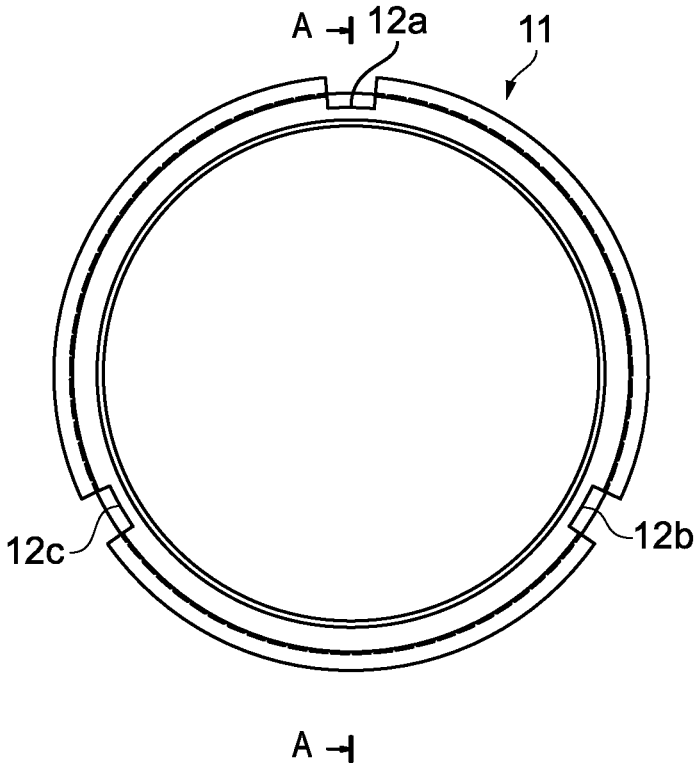
FIGS. 6A-C illustrate details of a seat element.
Figure 6B:
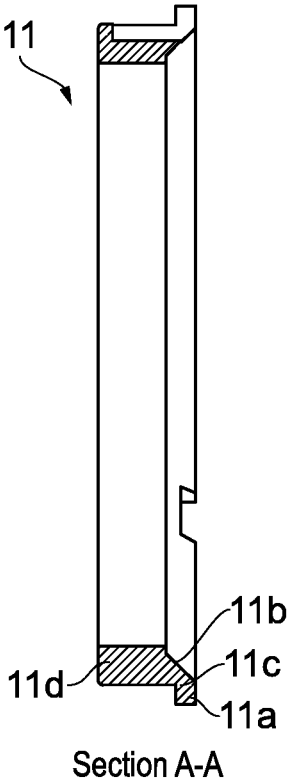
Figure 6C:
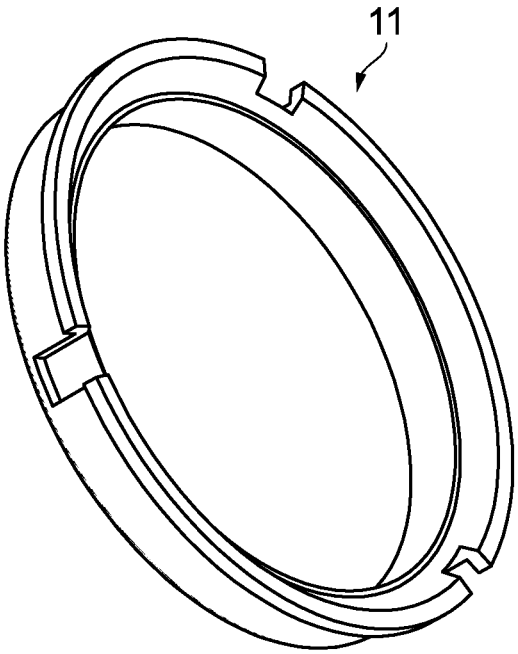

In the embodiment shown here, the plug arrangement 1 has three loading devices (blades) 4. FIGS. 6A-6C show the seat element 11 in some more detail. The seat element 11 comprises three recesses 12*a*-*c*, each blade 4 being arranged in a respective recess 12*a*-*c*. Thus, the seat element 11 and the blades 4 are arranged more compactly in relation to each other in the plug arrangement 1.

Figure 7:
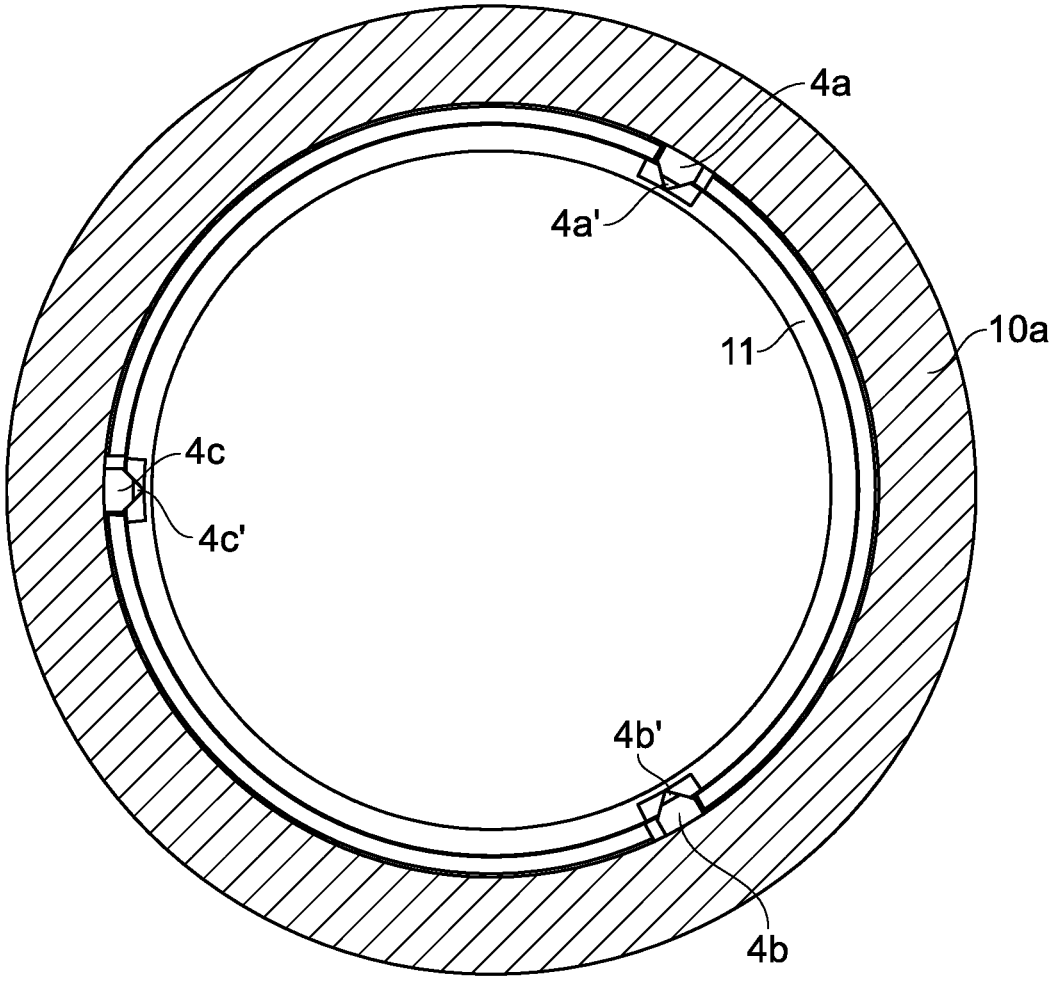
FIG. 7 shows a section of a plug arrangement.

FIG. 7 shows a section of the plug arrangement 1 from above. The blades 4*a*-*c* have respective contact faces 4*a*', 4*b*',4*c*' arranged to apply a pressure force on a part on the surface of the plug element 2, in order to crush it. When the plug element 2 is brought into contact with the contact faces 4*a*',4*b*',4*c*', a so-called point load is thus applied, which, for example, a glass element can only withstand to a certain degree. Therefore, by applying a pressure force higher than the limit the glass element is able to withstand, the glass element can be crushed.

Figure 8:
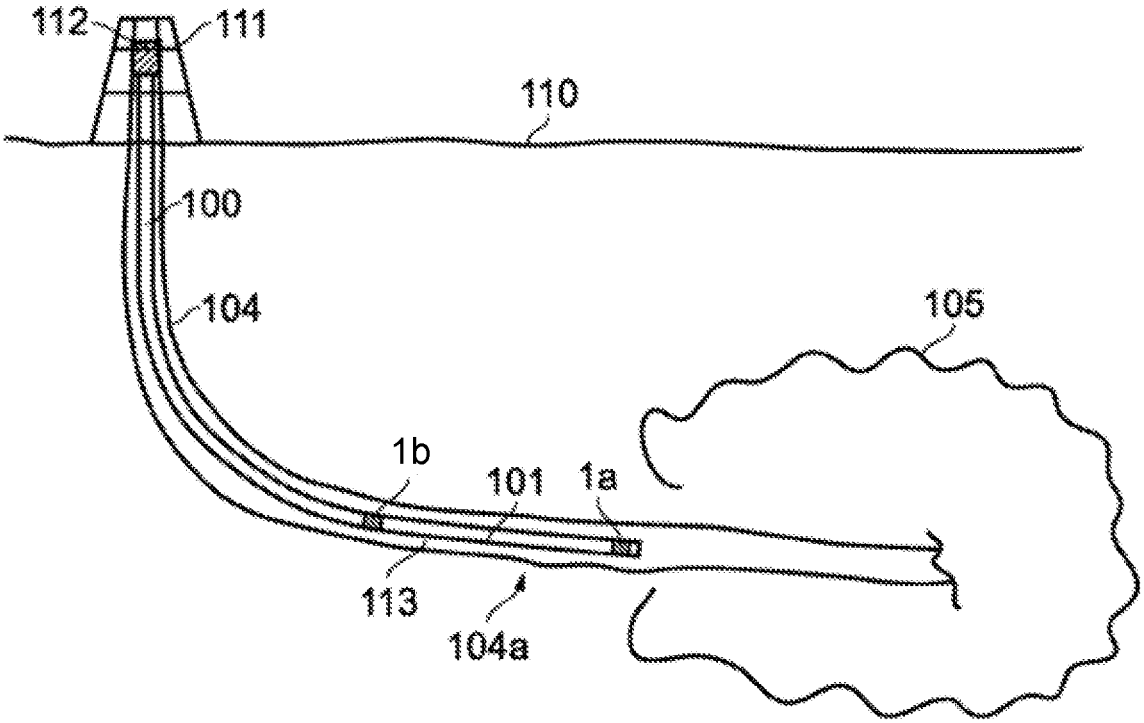
FIGS. 8-10 illustrate various aspects of a wellbore completion.
Figure 9:
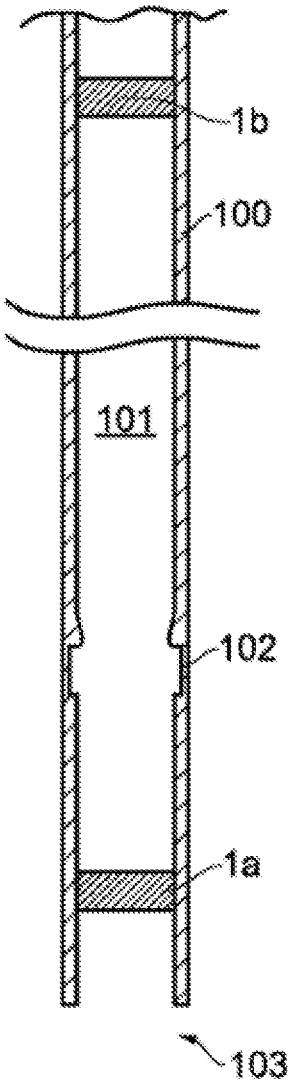

In an embodiment of the invention, a completion pipe 100 is provided, illustrated in FIGS. 8 and 9, comprising a plug arrangement 1 according to one of the embodiments described here, where the pipe string 10 constitutes parts or the whole of the completion pipe 100. The completion pipe 100 may have more than one plug arrangement, for example, a first plug arrangement 1*a* and a second plug arrangement 1*b*, as illustrated in FIGS. 8 and 9. The first and the second plug arrangement 1*a*,1*b* can define between them an inner volume 101 in the completion pipe 100. The first and the second plug arrangement 1*a*,1*b* can be of identical configuration, or of different configuration, for example, if there are different requirements for the two plug arrangements 1*a*,1*b* due to their position in the completion pipe 100. The completion pipe 100 can in an embodiment also comprise a locking mechanism 102 arranged in the completion pipe 100 and provided to lock a cement displacement element. The completion pipe 100 according to these embodiments will be described in more detail below.

Figure 11:
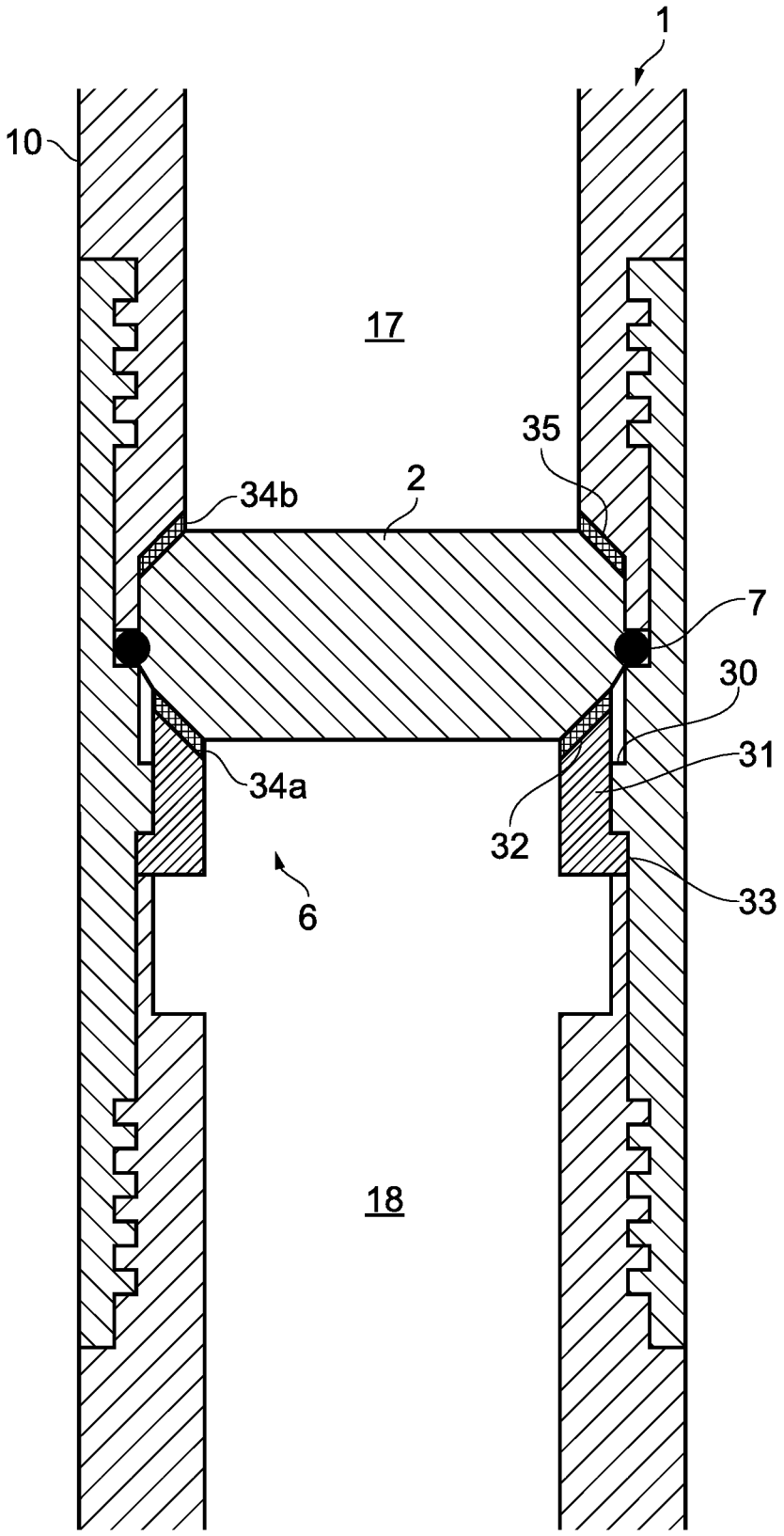
FIGS. 11 and 12 illustrate a plug arrangement according to another embodiment.
Figure 12:
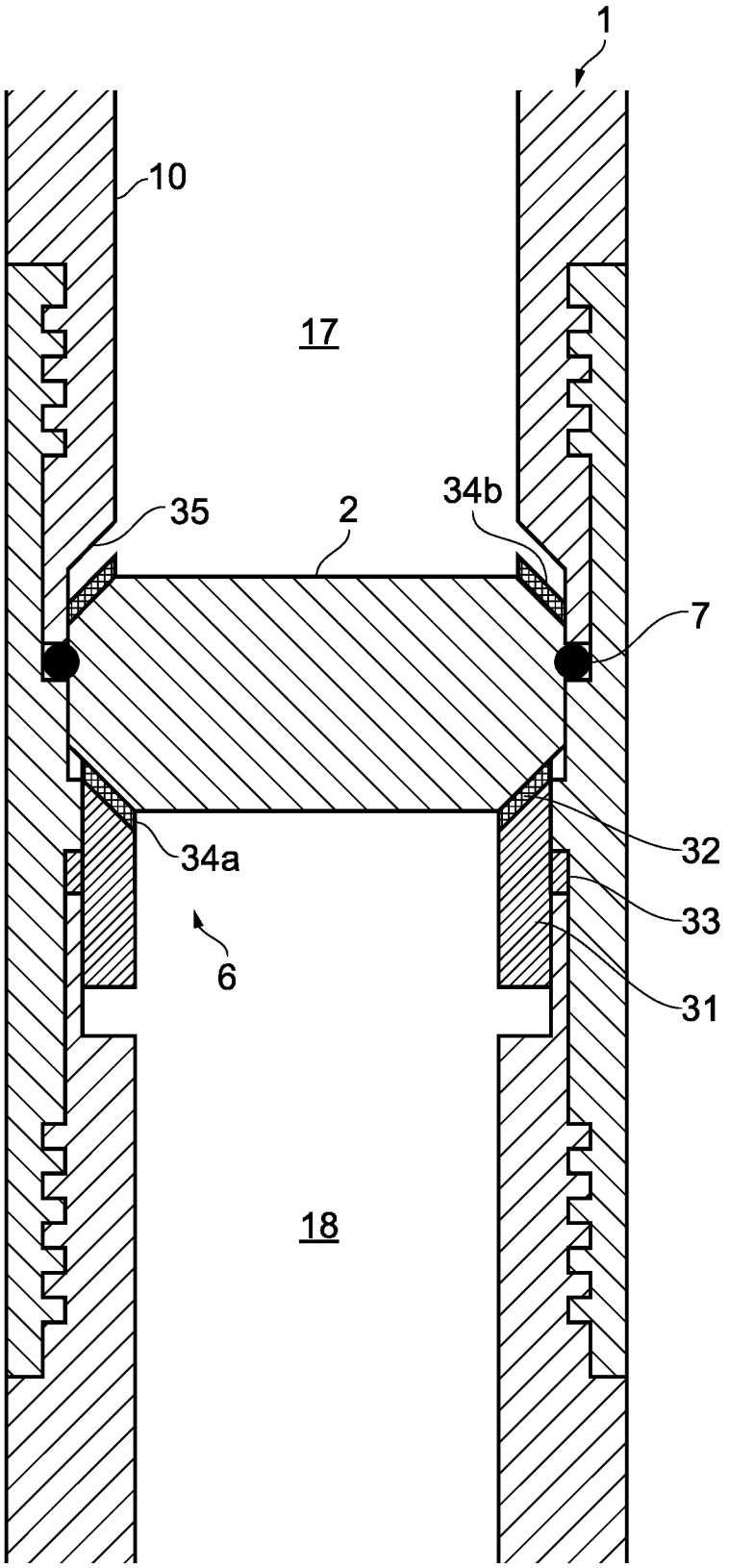

In an embodiment, illustrated in FIGS. 11 and 12, a plug arrangement 1 with a disintegratable plug element 2 is provided arranged in a plug housing 6 in a pipe string 10 and a seal element 7 arranged to seal between the plug element 2 and the pipe string 10. The plug element 2 is movable in the axial direction of the pipe string 10 between a first position in which the plug element 2 is spaced from a first ring-shaped seat 30 in the plug housing 6 and a second position in which the plug element 2 is in contact with the first ring-shaped seat 30. FIG. 11 shows the first, upper position whilst FIG. 12 shows the plug element 2 during its movement downward towards the second, lower position.

An axially movable seat element 31 with a second ring-shaped seat 32 is provided to support the plug element 2 in the first, upper position, as shown in FIG. 11. The seat element 31 has a shear element 33 arranged against the plug housing 6, for example, in a recess in the plug housing 6 for this purpose, in order to prevent axial movement of the seat element 11 until the shear element 33 has applied thereto a force higher than a predetermined resisting force.

To activate the plug arrangement 1, a pressure is applied in the inner volume 17 of the pipe string 10 above the plug element 2. This results in the shear element 33 breaking, so that the support of the plug element 2 from the seat 32 is reduced or ceases, and the plug element 2 can then be moved axially in the plug housing 6. Due to the pressure in the volume 17, the plug element 2 moves towards its lower position and thus into contact with the seat 30.

The seat 30 can be constructed to provide less support to the plug element 2 than the seat element 31 did, such that the plug element 2, when it comes into contact with the seat 30 and is subjected to the pressure in the volume 17, is crushed, broken or disintegrates in some other way.

The seat 30 can for this purpose advantageously have a larger diameter than the seat 32. This results in the plug element 2, when resting against the seat 30, being subjected to greater bending forces than when it rests against the seat 32. These bending forces can be sufficient to start the disintegration of the plug element 2. A glass plug can, for example, have large tolerance for shear forces, but little tolerance for bending forces, such that configuring the seat 30 with a larger diameter than the seat 32 can provide a reliable disintegration of the plug element 2, and at the same time low risk of unintended disintegration of the plug element 2 before it is desirable to activate the plug arrangement 1.

Alternatively, or in addition, the seat 30 can be provided with a smaller face (area) than the seat 32. This means that the pressure acting on the plug element 2 from the seat 30 is higher than the pressure from the seat 32. The pressure from the seat 30 can be higher than the tolerance pressure for the plug element 2, such that the forces acting from the seat 30 result in a disintegration of the plug element 2.

An upper support surface 35 can be provided to support the plug element 2 in the upper position, on an opposite side of the second ring-shaped seat 32.

A support material 34*a*, 34*b* can be disposed between the seat 32 and the plug element 2, and/or between the support face 35 and the plug element 2. The support material 34*a,b* can be a relatively flexible material, for example, PEEK, brass, aluminium, rubber or a plastic material. The support material 34*a,b* can help to reduce the risk of inadvertent crushing of the plug element 2, in that the support material 34*a,b* protects the plug element 2 from local high contact stresses against the support face 35 or the seat 32.

The seal element 7 can be arranged to seal between the plug element 2 and the pipe string 10 in both the upper and the lower position. This has the effect of better ensuring a reliable activation of the plug arrangement 1, as the pressure in the volume 17 in the pipe string 10 can be increased continuously until disintegration of the plug element 2 is obtained.

Figure 13:
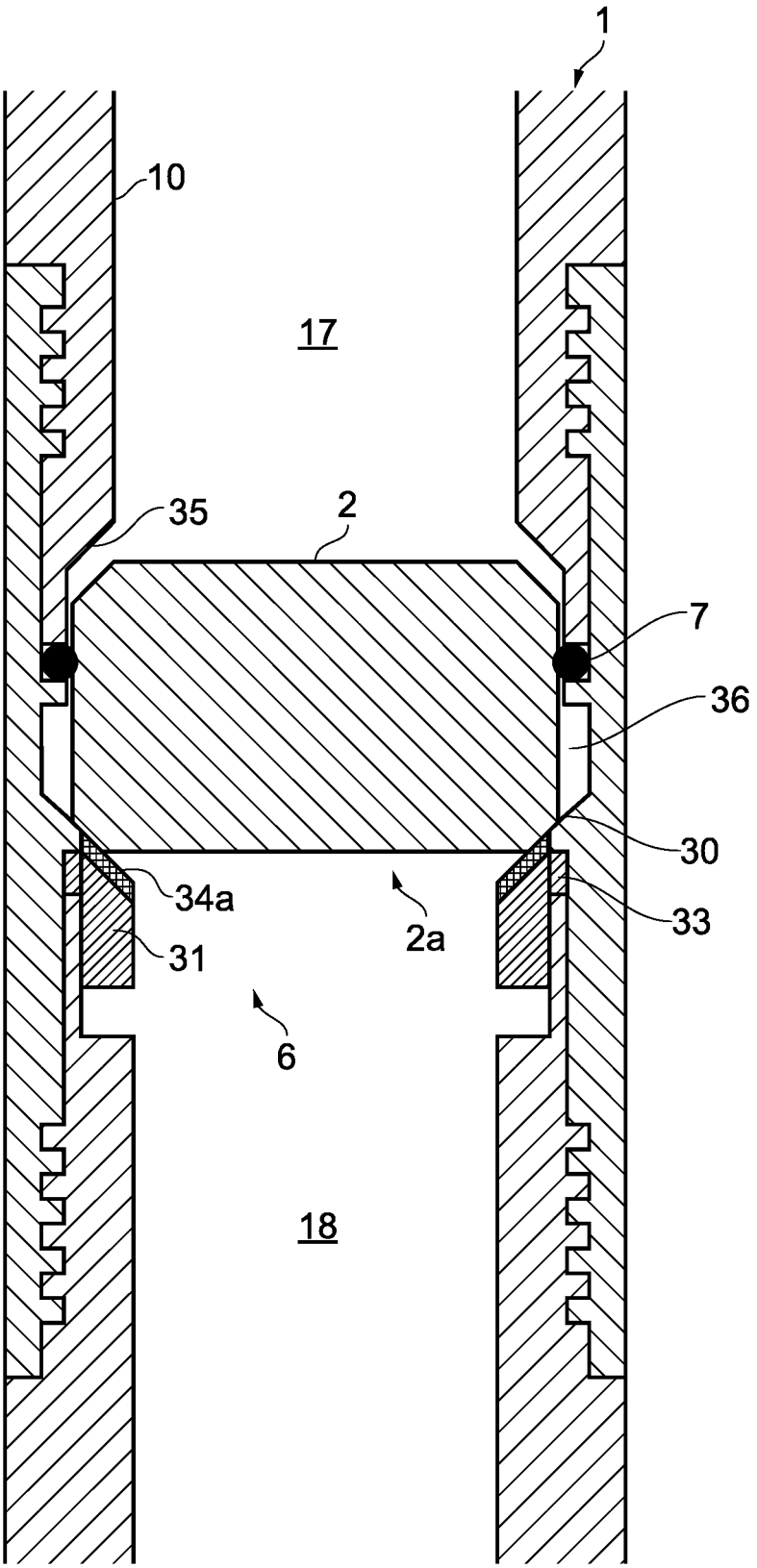
FIG. 13 illustrates a plug arrangement according to another embodiment.

In another embodiment, illustrated in FIG. 13, the plug arrangement 1 comprises a recess 36 in the plug housing 6. The recess 36 has a larger diameter than the outer diameter of the plug element 2 and is arranged so that it encloses a lower part 2*a* of the plug element 2 when the plug element 2 is in its lower position, as shown in FIG. 13. As a pressure is applied in the volume 17 above the plug element 2, the plug element 2 will because of the recess 36 more easily be bent. The recess 36 means that the plug element 2 has room to be bent outwardly into the plug housing 6 (i.e., extended radially). This increases the bending forces that act on the plug element 2 (as a result of the pressure in the volume 17), which gives a more certain disintegration of the plug element 2 since the plug element 2 because of the recess 36 lacks outer radial support in the lower part 2*a*. Furthermore, the risk of debris from the plug element 2 remaining in the plug housing 6 is reduced, as such bending results in breaks or ruptures in the outer surface on the sides of the plug element 2, which will ensure a more complete disintegration.

The use of such a recess 36 as described in relation to FIG. 13 can also be employed in the other embodiments described herein.

Figure 17:
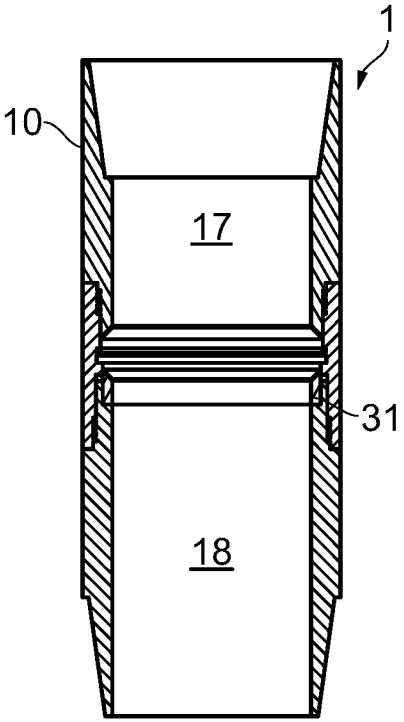
FIGS. 14-17 illustrate a sequence for activating a plug arrangement.
Figure 16:
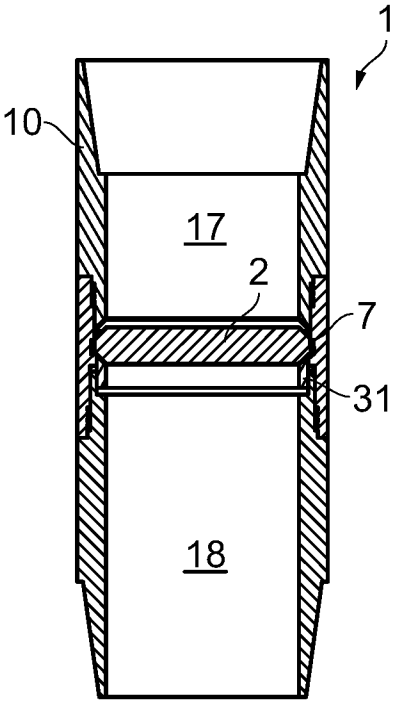
Figure 15:
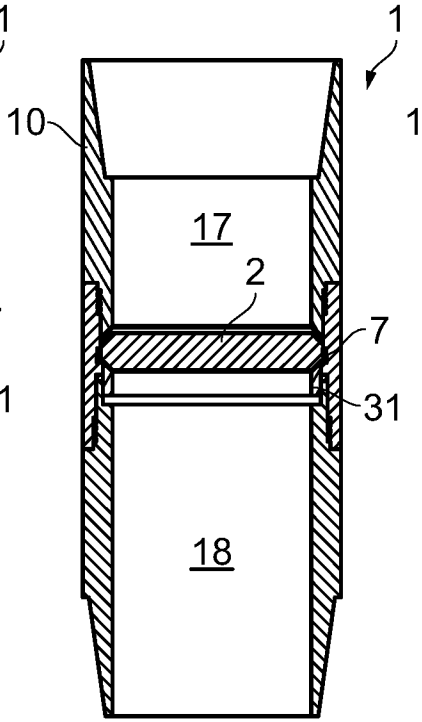
Figure 14:
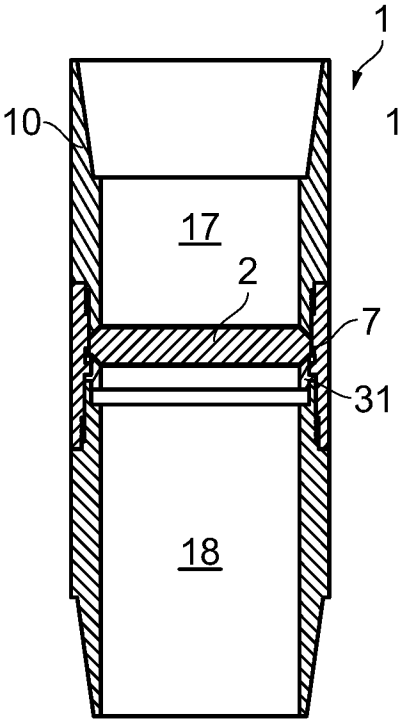

FIGS. 14-17 illustrate a sequence for activating the plug arrangement 1. In FIG. 14 the plug element 2 is in its first, upper position, i.e., supported by the support surfaces 32 and 35 (see FIG. 11). In FIG. 15, the volume 17 has been pressurised so that the shear element 33 has broken or been torn off, and the plug element 2 has started to move downwards, driven by the pressure in the volume 17. In FIG. 16, the plug element 2 has come into its second, lower position, where it comes into contact with the seat 30. The seat 30, in conjunction with the pressure in the volume 17, then generates increased pressure, bending and shear forces which act on the plug element 2 and cause the start of its disintegration. FIG. 17 shows the plug arrangement 1 after the plug element 2 has disintegrated.

In the embodiments shown in FIGS. 11-17, reliable activation of the plug arrangement 1 is therefore ensured by a combination of bending forces, shear forces and contact stresses on the plug element 2 that lead to its disintegration. Furthermore, advantages are obtained in that the inner surfaces in the pipe string 10, after activation of the plug arrangement 1, can be constructed such that they are substantially continuous, "smooth" and/or without large angles to the inner pipe wall. For example, the support surfaces 32,35 can be arranged at an angle of about 45 degrees. This minimises the risk of, for example, well tools used later (after activation) getting stuck in the plug housing 6. A further advantage is that the risk of a cutting element such as a blade or spike, becoming loose and preventing reliable activation of the plug arrangement 1, and/or that the blade or spike constitutes an obstacle in the inner passage of the pipe string 10 after activation.

Figure 18:
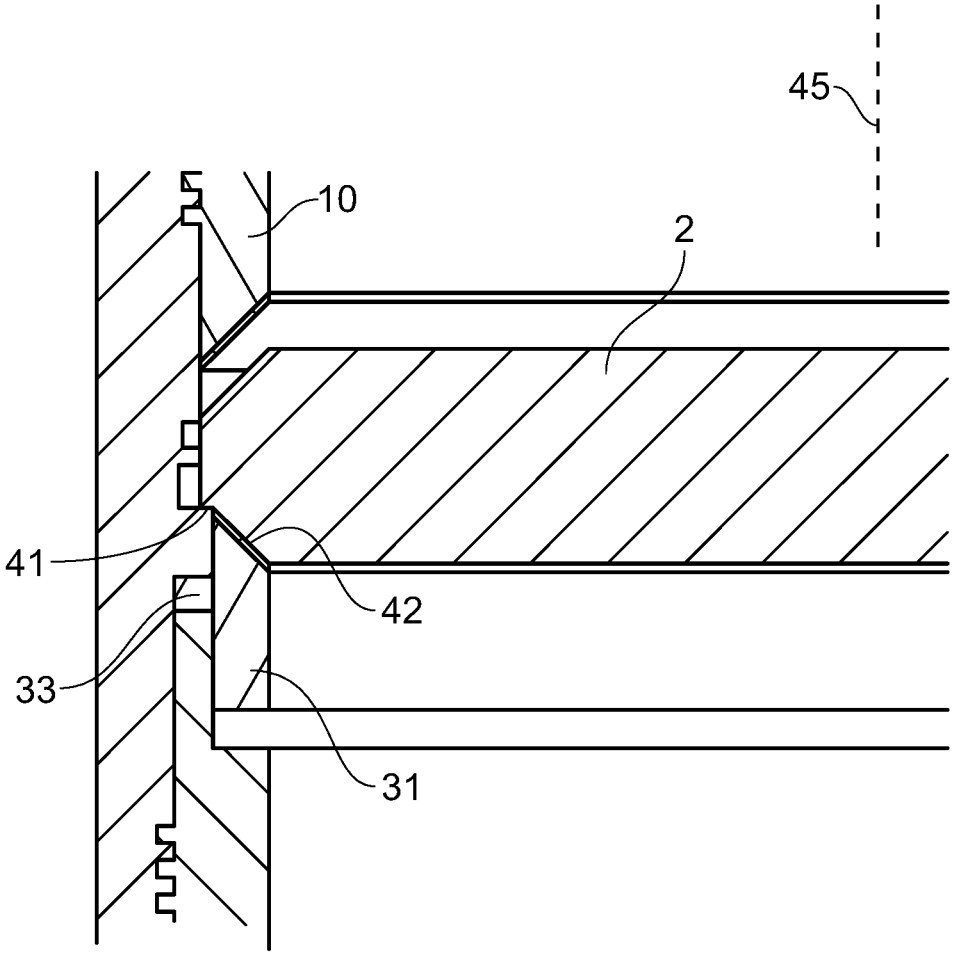
FIGS. 18-20 illustrate further embodiments of a plug arrangement.
Figure 19:
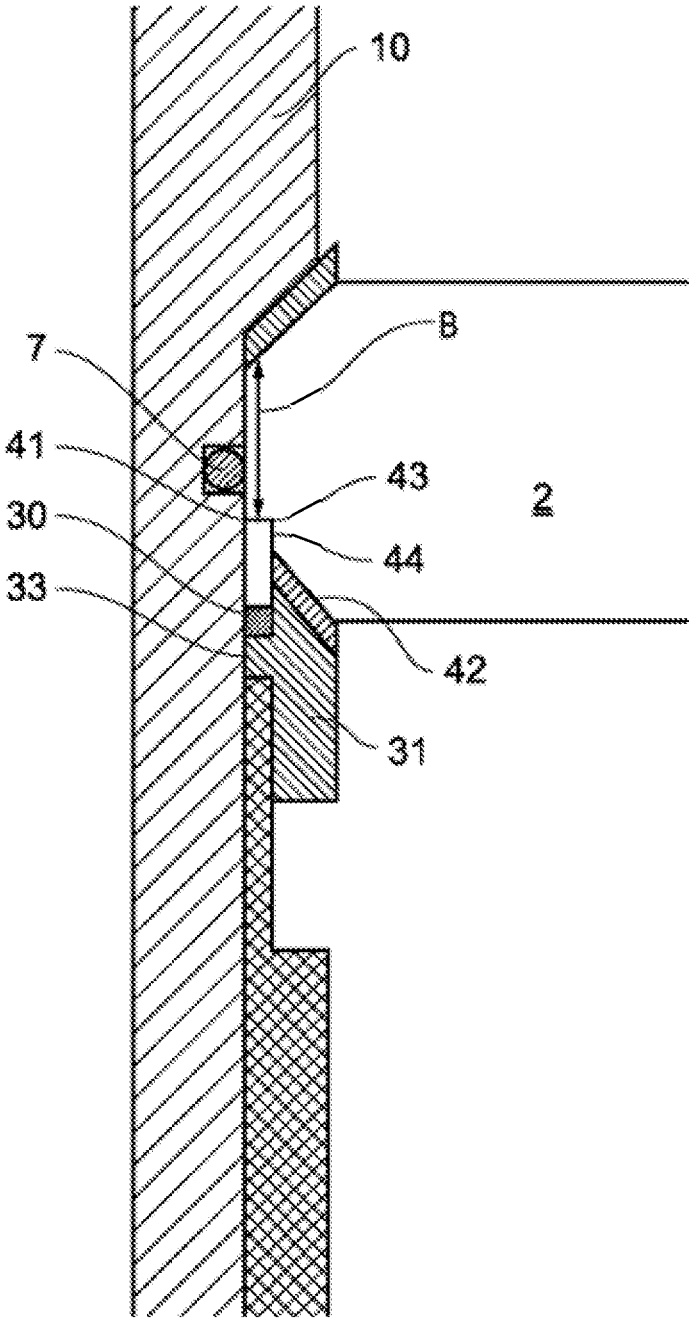
Figure 20:
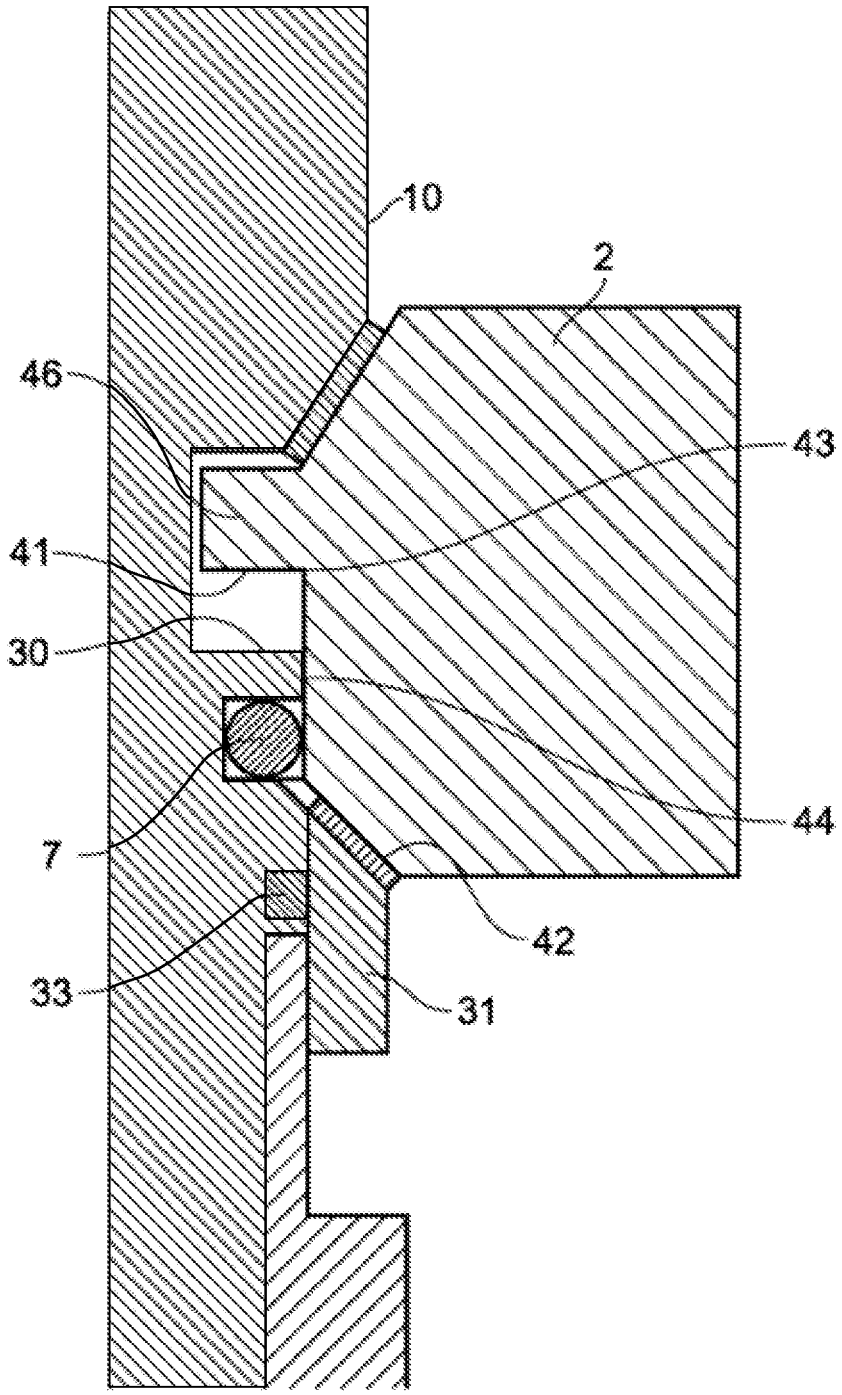

FIGS. 18-20 illustrate additional embodiments of a plug arrangement 1. FIG. 18 shows a section of FIG. 16. FIGS. 19 and 20 show other embodiments. As illustrated in FIGS. 18-20, the plug element 2 can have an abutment surface 41 that is arranged for abutment against the first ring-shaped seat 30 and a support surface 42 arranged for cooperation with the second ring-shaped seat 32.

In an embodiment, the abutment surface 41 is arranged in an extension of the support surface 42 and is flush with the support surface 42. (See e.g., FIG. 11.) This gives advantages in the manufacture of the plug element 2 and results in good structural stability thereof.

As illustrated in FIGS. 19 and 20, the abutment surface 41, in an embodiment, is separated from the support surface 42 by an intermediate face 44 and/or a machined edge 43 is arranged between the abutment surface 41 and the support surface 42. This gives freedom to better determine the structural strength of the plug element 2 in the area around the support surface 42 and the abutment surface 41. For example, as shown in FIG. 19, it may be desirable to have a smaller thickness B in the extension of the abutment surface 41 than in the extension of the support surface 42, in order to provide structural strength in the support phase, but allow effective crushing/disintegration of the plug element 2 when the plug arrangement 1 is to be activated.

Similarly, the angles of the support surface 42 and the abutment surface 41 can be adjusted relative to one another and/or relative to the central through axis 45 (the longitudinal axis) of the plug arrangement 1. The abutment surface 41 can, for example, be angled relative to the support surface 42. Alternatively, or in addition, the abutment surface 41 can be arranged substantially perpendicular in relation to the longitudinal axis 45. Alternatively, or in addition, the support surface 42 can be arranged with an angle that is not perpendicular in relation to the longitudinal axis 45, i.e., inclined. An inclined surface at the outer edge of the plug element 2 can give better structural stability than a perpendicular surface, and by selecting suitable angles for the support surface 42 and the abutment surface 41, the structural strength of the plug element 2 in the support phase and in the disintegration/crushing phase can be adapted to desired values. The plug element 2 could, for example, be machined to obtain the desired angles, for example, by grinding if the plug element 2 is a glass plug.

Similarly, the first ring-shaped seat 30 can be arranged essentially perpendicular to the central through axis 45 of the plug arrangement 1 (see FIG. 18). Alternatively, or in addition, the second ring-shaped seat 32 can be arranged at an angle that is not perpendicular in relation to the central through axis 45 of the plug arrangement 1, i.e., that the second ring-shaped seat 32 can be inclined. The abutment surface 41 and the first ring-shaped seat 30 need not necessarily have the same angle; they can be arranged at a mutual angle relative to each other to increase the disintegration/crushing effect. See, for example, FIG. 11.

FIG. 20 shows an embodiment where the abutment surface 41 is arranged on a radial protrusion 46 around the plug element 2. This can further improve the disintegration/crushing effect of the plug, as the thickness of the plug element 2 in the extension of the abutment surface 41 can be made smaller. The plug element 2 will therefore be subjected to higher bending and shear forces, and these, combined with inner stresses in the plug element 2, then lead to disintegration/crushing thereof. FIG. 20 also shows that the abutment surface 41 can be arranged in the upper part of the plug element 2, with the seal element 7 below it.

An example of the use of a plug arrangement 1 and a completion pipe 100 according to one or more of the embodiments described above will now be described with reference to FIGS. 1-17. It should be understood that the plug arrangement 1 could also have applications other than the example described here, where the plug arrangement 1 is arranged as a flotation plug for installation of a completion pipe. Furthermore, it should be understood that completion pipe here is meant as a generic term, and the area of utilisation may comprise, for example, casing or other pipes used in a petroleum well.

FIG. 8 illustrates a well 104 drilled in a subterranean formation. The well runs from a surface 110 (which can be dry land, a seabed or a deck on an offshore platform) towards or into a petroleum reservoir 105. A drilling rig 111 has a hoisting system 112 that lowers the completion pipe 100 into the well 104.

The completion pipe has a first and a second plug arrangement 1*a*,1*b* (see FIGS. 8 and 9) which define between them an inner volume 101 in the completion pipe 100. The inner volume 101 is gas-filled. This gives the completion pipe 100 increased buoyancy and reduces the friction between the completion pipe 100 and the well walls when the completion pipe 100 is run into a partly or wholly horizontal part 104*a* of the well 104.

When a sufficient length of completion pipe 100 has been run into the well 104, the completion pipe 100 will be cemented in place in the well 104. The second (uppermost) plug arrangement 1*b* is for this purpose activated by pressurising the volume 17 above it. This volume can be pressurised from the drilling rig 111, via the inner passage of the completion pipe 100. The plug arrangement 1*b* is thus "activated", and the plug element 2 therein is crushed. The inner passage of the completion pipe 100 is now open down to the first plug arrangement 1*a*, and this can be activated (i.e., opened) in the same way. The completion pipe 100 is now open, and cementing can be carried out by pumping cement down through the completion pipe 100, out of its end opening 103 (see FIG. 9) and up through an annulus 113 (see FIGS. 8 and 10) between the completion pipe 100 and the well 104.

The plug arrangements 1*a* and 1*b* may be identical in design, or different. For example, the upper plug arrangement 1*b* can be equipped with a seat 11 as shown in FIG. 1, whilst the lower plug arrangement 1*a* is a plug like that shown in FIG. 1, but without a seat, as the plug element 2 in the lower plug arrangement 1*a* can, under certain conditions, be held in place by the pressure differential between the hydrostatic pressure outside the completion pipe 100 and the pressure in the inner volume 101 and therefore not necessarily need the seat 11.

When cementing has been completed, there may be a need to ensure that hardened cement does not flow back from the annulus 113 and in through the opening 103. For this purpose, the completion pipe 100 can comprise a locking mechanism 102 (see FIG. 9) arranged in the completion pipe 100 and adapted to lock a cement displacement element in place. The cement displacement element can, for example, be a cement dart or a similar element. The method can thus comprise passing a cement displacement element through the completion pipe 100 and bringing the cement displacement element into contact with a locking mechanism 102 arranged in the completion pipe 100 and provided to lock the cement displacement element in place. The cement displacement element can, for example, be pumped down in the completion pipe 100 after the cement, and be in a form that scrapes the completion pipe 100 clean on its way downwards, and is then locked in place in the locking mechanism 102.

In some embodiments, the use of a plug arrangement 1*a* in a completion pipe 100 and in a method as described above, will allow the whole of the inner passage of the completion pipe 100 to have an approximately full inside diameter (ID) when the plug arrangement(s) is/are activated/opened, up until and including in the opening 103. In addition, it is possible to avoid elements in the inner passage on which well tools, debris etc. can get stuck during or after completion. The risk of blocking the completion pipe is thus reduced. The use of a plug arrangement according to embodiments described herein in a toe section of a completion pipe, can replace today's cement flotation valves/non-return valves. This may be an advantage as a typical non-return valve will have an inside diameter (ID) restriction that is prone to being blocked with impurities and debris, and can thus prevent the cement from being pumped into the formation as desired.

To prevent the cement from seeping back into the pipe, which normally is the job of the non-return valve, a locking mechanism 102 can be used that catches a cement dart and locks it in place. The locking mechanism 102 for the cement dart can in principle be placed anywhere, but would typically be arranged immediately above or in the plug arrangement 1*a* housing.

Figure 10:
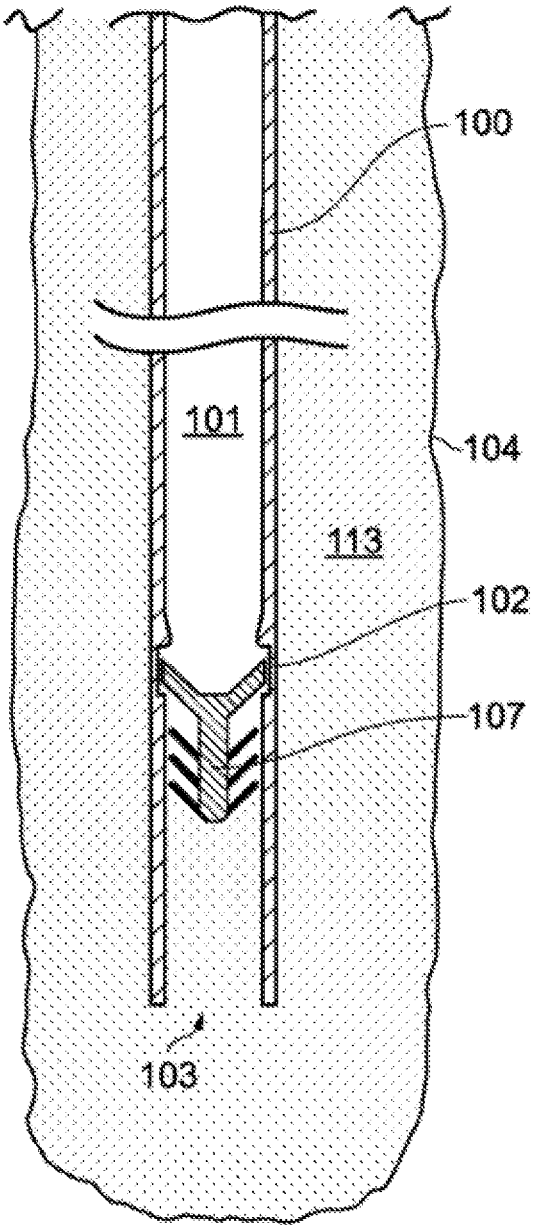

This is illustrated in FIG. 10 where a cement dart 107 has engaged with the locking mechanism 102 and the annulus 113 is filled with cement. Pumping the cement dart 107 down into the completion pipe 100 behind the cement causes the dart to push the cement down ahead of it and out through the end 103 of the completion pipe 100 and into the annulus 113. When the cement dart 107 reaches the locking mechanism 102, it is locked and held in place on the outside. This may be necessary as the cement that is pressed out between the pipe and the formation often has a higher specific gravity than the water/liquid standing in the completion pipe 100 above the cement dart and takes time to harden. The locking mechanism 102 thus prevents the cement dart and water from being pressed back up into the completion pipe 100. In the case of easy and/or rapid hardening cement, use of a locking mechanism 102 can, however, be optional, as backflow can be prevented, for example, by keeping the completion pipe 100 pressurised for a specific period after the cementing process has been completed.

A further advantage of embodiments described herein may be that at a later stage, if desirable, the drilling out of a flotation valve or non-return valve (which typically is a steel structure) at the bottom of the completion pipe 100 can be avoided if it is desired to drill a longer well based on the original well path. A cement dart does not have very high strength requirements and may well consist only of outer elastomer that scrapes or wipes the completion pipe 100 clean of cement, and a core of composite, aluminium, castings or other material that is easy to drill out later. A plug arrangement 1 according to embodiments described above will also be substantially simpler to make than, for example, a non-return valve and therefore lowers the cost of the equipment. Another advantage may be that in some embodiments there are fewer types of equipment to deal with, which gives production, logistics and cost advantages.

The plug element 2 can, for example, be of toughened or tempered glass that is cut across by the blades 4, such that they penetrate the toughened layer of the glass, thereby releasing the inner stresses in the glass. The plug arrangement 1 is not dependent on this happening quickly or with a certain kinetic energy, as the plug element 2 need only be pressed against the blades 4. This can take place slowly if necessary; penetration of the toughened layer will lead to the inner stress in the glass being released and crushing the glass, and the plug arrangement 1 is not dependent on, for example, a high-energy impact against an abutment surface to crush the plug element 2. Another advantage is that by such controlled crushing, the size of the particles after crushing the plug element 2 will more easily be controlled, thereby avoiding the risk of large pieces. Through a suitable selection of material and pre-treatment (e.g., toughening or tempering), the particle size of the debris/junk from the plug element 2 can be carefully controlled, and the crushing result will be more consistent and predictable, depending on the well conditions. This can eliminate the need for using a debris catcher, which is a cost-increasing element and creates an undesirable restriction in the wellbore. The plug arrangement according to one or more of the embodiments described above also has advantages in that the number of leakage paths and/or the number of components in the arrangement are reduced, whereby it is possible to obtain a simpler structure with higher reliability, and that the plug arrangement is compact but at the same time obtains a large inside diameter (ID) in the pipe string 10 and/or the completion pipe 100 and a small outer diameter (OD) of the same, whilst maintaining structural integrity and pressure rating.

The invention is not limited to the embodiments described herein; reference should be had to the appended claims.

The invention claimed is:

1. A plug arrangement comprising: a disintegratable plug element arranged in a plug housing in a pipe string, the pipe string having a pressure-resistant wall which delimits an inner passage in the pipe string from an outside of the pipe string, wherein the plug element is arranged adjacent the pressure-resistant wall and a seal element is arranged to seal between the plug element and the pressure-resistant wall, and where the plug element is movable in an axial direction of the pipe string between:

a first position in which the plug element is spaced from a first ring-shaped seat in the plug housing, and a second position in which the plug element is in physical contact with the first ring-shaped seat in the plug housing, wherein the plug arrangement further comprises an axially movable seat element with a second ring-shaped seat arranged to support the plug element in the first position, where the seat element has a shear element arranged against the plug housing to prevent axial movement of the seat element until the shear element is subjected to a force higher than a predetermined force.

2. The plug arrangement according to claim 1, further comprising a loading device that has a contact surface arranged to apply a pressure force on a part of the surface of the plug element.

3. The plug arrangement according to claim 2, wherein the loading device comprises at least one pin, spike, or blade.

4. The plug arrangement according to claim 2, wherein the loading device is fixed in the plug housing.

5. The plug arrangement according to claim 1, where the second ring-shaped seat is axially movable in the plug housing and has a first part that is arranged to rest against a support surface in the plug housing to prevent axial movement of the second ring-shaped seat, and where the plug element is arranged on a second part of the second ring-shaped seat, and wherein:

(i) the first part is connected to the second part with a connecting part and where the connecting part is arranged to break when subjected to a force which is higher than a predetermined breaking force; and/or (ii) the support surface is arranged to yield when subjected to a force which is higher than a predetermined support force.

6. The plug arrangement according to claim 5, wherein the first part is arranged as a protrusion around at least a part of a circumference of the seat element.

7. The plug arrangement according to claim 1, comprising a recess arranged in the plug housing, where the recess has a larger diameter than an outer diameter of the plug element, and where the recess is arranged such that it encloses a lower part of the plug element when the plug element is in its second position.

8. A plug arrangement comprising:

a disintegratable plug element arranged in a plug housing in a pipe string;

a seal element arranged to seal between the plug element and the pipe string, where the plug element is movable in an axial direction of the pipe string between:

a first position in which the plug element is spaced from a first ring-shaped seat in the plug housing, and a second position in which the plug element is in physical contact with the first ring-shaped seat in the plug housing, wherein the plug arrangement further comprises an axially movable seat element with a second ring-shaped seat arranged to support the plug element in the first position, where the seat element has a shear element arranged against the plug housing to prevent axial movement of the seat element until the shear element is subjected to a force higher than a predetermined force.

9. The plug arrangement according to claim 8, wherein the first ring-shaped seat has at least one of:

a larger diameter than the second ring shaped seat, or a smaller surface than the second ring shaped seat.

10. The plug arrangement according to claim 8, wherein the plug housing has a support surface arranged to support the plug element in the first position on an opposite side of the second ring-shaped seat.

11. The plug arrangement according to claim 8, further comprising a recess arranged in the plug housing, where the recess has a larger diameter than an outer diameter of the plug element, and where the recess is arranged so as to enclose a lower part of the plug element when the plug element is in its second position.

12. The plug arrangement according to claim 8, wherein the seal element is arranged to seal between the plug element and the pipe string in both the first and the second position.

13. A completion pipe comprising a plug arrangement according to claim 8, wherein the pipe string forms part of or the whole of the completion pipe.

14. The completion pipe according to claim 13, wherein the plug arrangement is a first plug arrangement and the completion pipe further comprises a second plug arrangement, where the first and the second plug arrangement define between them an internal volume of the completion pipe.

15. The completion pipe according to claim 13, comprising a locking mechanism arranged in the completion pipe and arranged to lock a cement displacement element in place.

16. A method for arranging a completion pipe in a well, where the completion pipe comprises a first and a second plug arrangement which each have a disintegratable plug element and an activation mechanism arranged to cause disintegration of the plug element, and where the first and second plug arrangement define an internal volume in the completion pipe, the method comprising:

running the completion pipe into the well;

causing disintegration of the plug element in the second plug arrangement by activating the activation mechanism from a surface;

causing disintegration of the plug element in the first plug arrangement by activating the activation mechanism from the surface; and pumping a cement down through the completion pipe and out of an end opening of the completion pipe;

wherein at least one of the first and second plug arrangements is a plug arrangement according to claim 8.

17. The method according to claim 16, further comprising passing a cement displacement element through the completion pipe and bringing the cement displacement element into engagement with a locking mechanism arranged in the completion pipe and arranged to lock the cement displacement element in place.

* * * * *